US012416475B2

(12) United States Patent
Pittman et al.

(10) Patent No.: US 12,416,475 B2
(45) Date of Patent: Sep. 16, 2025

(54) BALLISTIC VEST

(71) Applicant: Safariland, LLC, Jacksonville, FL (US)

(72) Inventors: David Lynn Pittman, Pomona, CA (US); Scott Timothy O'Brien, Chino Hills, CA (US); Todd Lavik Wilson Mackler, San Juan Capistrano, CA (US); James A. Duncan, Yorba Linda, CA (US); Tim O'Brien, Chino Hills, CA (US)

(73) Assignee: Safariland, LLC, Jacksonville, FL (US)

( * ) Notice: Subject to any disclaimer, the term of this patent is extended or adjusted under 35 U.S.C. 154(b) by 69 days.

(21) Appl. No.: 17/979,903

(22) Filed: Nov. 3, 2022

(65) Prior Publication Data

US 2023/0145266 A1 May 11, 2023

Related U.S. Application Data

(60) Provisional application No. 63/276,314, filed on Nov. 5, 2021.

(51) Int. Cl.
*F41H 1/02* (2006.01)
*A41D 1/04* (2006.01)
(Continued)

(52) U.S. Cl.
CPC ..... *F41H 1/02* (2013.01); *A41D 1/04* (2013.01); *A41D 13/0518* (2013.01); *F41H 5/013* (2013.01)

(58) Field of Classification Search
CPC ..... F41H 1/02; F41H 1/013; A41D 13/0518; A41D 1/04
See application file for complete search history.

(56) References Cited

U.S. PATENT DOCUMENTS 3,843,969 A 10/1974 George et al.
3,973,275 A 8/1976 Blauer
(Continued)

FOREIGN PATENT DOCUMENTS

FR 2814916 A1 10/2000
WO 2005119162 A2 12/2005

OTHER PUBLICATIONS

PCT Application No. PCT/US2022/048850—PCT International Search Report and Written Opinion dated Jun. 6, 2023.
(Continued)

*Primary Examiner* — Patrick J. Lynch
(74) *Attorney, Agent, or Firm* — Kane Kessler, P.C.; Paul E. Szabo

(57) ABSTRACT

A ballistic vest includes ballistic panels supported in a carrier, including a front panel and a back panel. The carrier includes an outer layer and an inner layer joined to each other at the top and bottom of the vest and open at the sides. The carrier layers define between them a panel space having an upper part located above the bottom of vest armholes and a lower part located below the bottom of vest armholes. A front panel upper section is secured in the upper part of the panel space. A front panel lower section is free to move laterally in the lower part of the panel space. A back panel upper section is secured in the upper part of the panel space. A back panel lower section is substantially free to move laterally in the lower panel space.

4 Claims, 8 Drawing Sheets

(51) Int. Cl.
*A41D 13/05* (2006.01)
*F41H 5/013* (2006.01)

(56) References Cited

U.S. PATENT DOCUMENTS

| | | | | |
|---|---|---|---|---|
| 4,266,297 | A * | 5/1981 | Atkins | F41H 1/02 2/2.5 |
| 4,485,491 | A | 12/1984 | Rasmussen | |
| 4,507,802 | A | 4/1985 | Small | |
| 4,578,821 | A | 4/1986 | Zufle | |
| 5,157,792 | A | 10/1992 | Allen et al. | |
| 6,260,196 | B1 | 7/2001 | van der Sleesen | |
| 6,681,400 | B1 | 1/2004 | Mills | |
| 7,080,411 | B2 | 7/2006 | Kerr | |
| 7,748,053 | B1 * | 7/2010 | Hancock | F41H 1/02 2/2.5 |
| 10,094,640 | B2 | 10/2018 | Aquino | |
| 2007/0169244 | A1 * | 7/2007 | Wells, Jr. | F41H 1/02 2/2.5 |
| 2007/0234459 | A1 * | 10/2007 | Stewart | F41H 1/02 2/2.5 |
| 2009/0151036 | A1 | 6/2009 | Joseph | |
| 2011/0023201 | A1 * | 2/2011 | Pearl | F41H 1/02 2/2.5 |
| 2012/0174276 | A1 | 7/2012 | Craffey | |
| 2013/0291268 | A1 * | 11/2013 | Whaley | F41H 1/02 2/2.5 |
| 2015/0059042 | A1 * | 3/2015 | Aquino | A41B 1/08 2/2.5 |
| 2015/0216744 | A1 * | 8/2015 | Hanna | A41D 31/24 2/2.5 |
| 2015/0285594 | A1 * | 10/2015 | Seuk | F41H 1/02 2/2.5 |
| 2016/0044976 | A1 | 2/2016 | Nykoluk et al. | |
| 2017/0082403 | A1 * | 3/2017 | Aquino | F41H 1/02 |
| 2017/0097210 | A1 | 4/2017 | Ballesteros Casas | |
| 2018/0160744 | A1 * | 6/2018 | Blauer | F41H 1/02 |
| 2018/0364011 | A1 | 12/2018 | Blakeley | |
| 2021/0356235 | A1 | 11/2021 | Wilson | |
| 2022/0290945 | A1 * | 9/2022 | Blauer | A41D 13/0518 |
| 2024/0175662 | A1 * | 5/2024 | Ross | F41H 5/013 |

OTHER PUBLICATIONS

Prior art front opening vest with carrier panel wing fitted into cradle during donning of vest.
European Patent Appln. No. 22893489.9—Extended European search report dated Mar. 18, 2025.

* cited by examiner

BALLISTIC VEST

BACKGROUND OF THE INVENTION

Some ballistic vests are constructed as a set of ballistic panels (soft armor) supported in a carrier. Many of these ballistic vests are relatively inflexible, unaccommodating to movement of the user, and thus uncomfortable. A vest that is constructed in accordance with the present invention can help to overcome those deficiencies.

BRIEF DESCRIPTION OF THE DRAWINGS

Features of the invention will become apparent to one of ordinary skill in the art to which the invention pertains from a reading of the following description together with the accompanying drawings, in which.

DESCRIPTION OF EMBODIMENTS OF THE INVENTION

Figure 1:
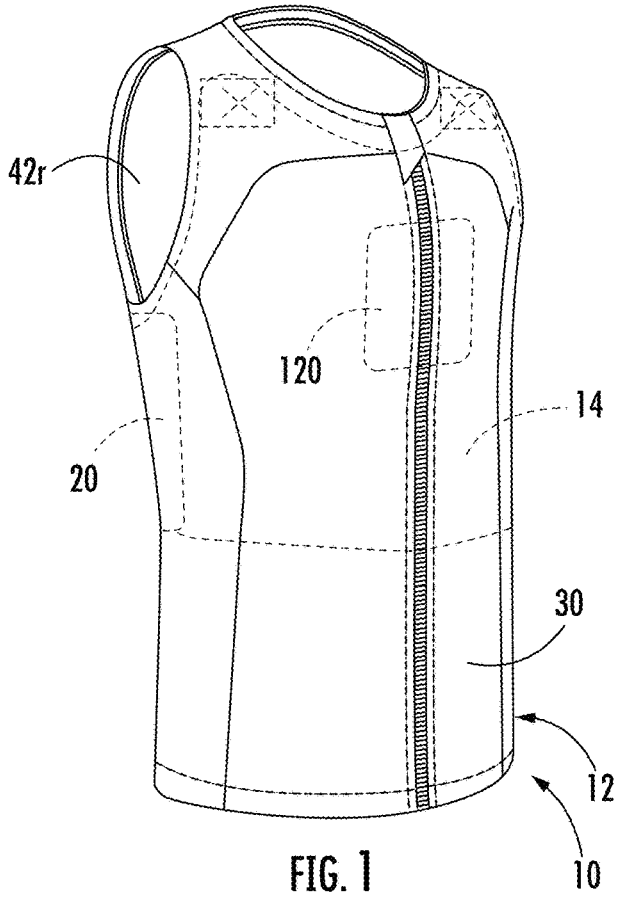
FIG. 1 is a right front perspective view of a ballistic vest that is one embodiment of the invention, the vest including a carrier that is made from fabric material and that has pockets that carry ballistic panels.
Figure 2:
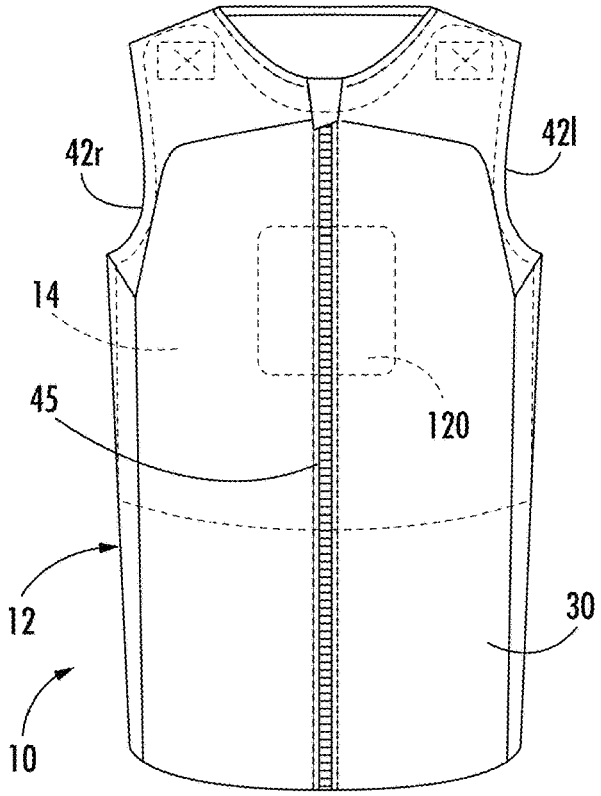
FIG. 2 is a front elevational view of the vest of FIG. 1.
Figure 3:
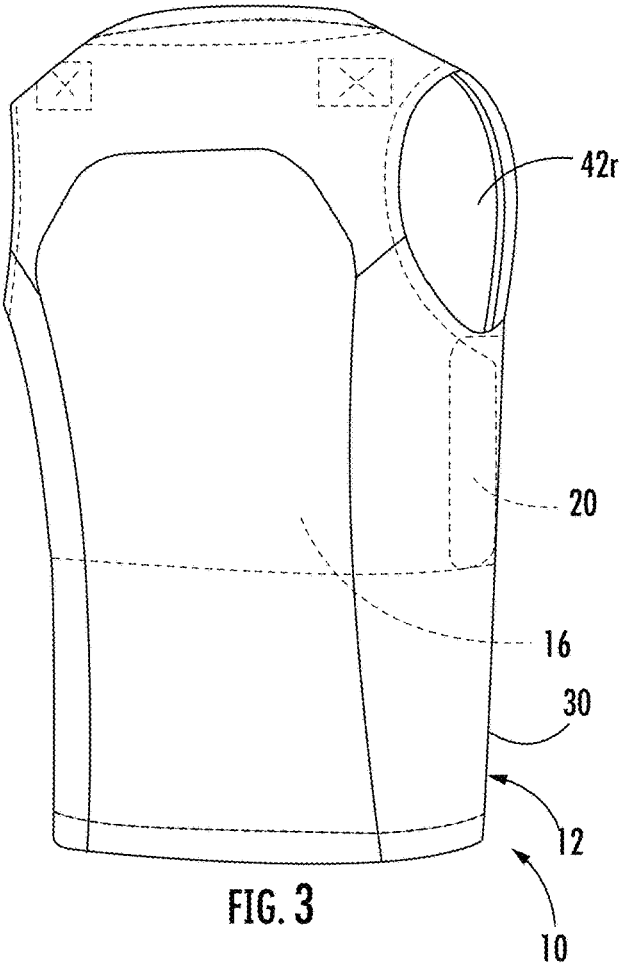
FIG. 3 is a back right perspective view of the vest of FIG. 1.

The present invention relates to a ballistic vest. The invention is applicable to vest of different constructions. As representative of the invention, FIG. 1 illustrates a vest 10 that is a first embodiment of the invention.

One major component of the vest 10 is a carrier 12. The other main component of the vest 10 is a plurality of ballistic panels or ballistic inserts (soft armor). In the particular vest 10 that is illustrated, there are four ballistic panels: a front ballistic panel 14, a back ballistic panel 16, a left side ballistic panel 18, and a right side ballistic panel 20. Other vests in accordance with the invention might have more than four ballistic panels or fewer than four ballistic panels. As described below, the ballistic panels 14-20 are inserted into the carrier 12 after the carrier is itself assembled; thereafter, the vest 10 can be donned by the user.

The carrier 12 in the illustrated embodiment includes as its two major components a carrier outer layer 30 and a carrier inner layer 60. One or both of the carrier layers 30 and 60 may be made from a number of individual fabric panels that are joined together, preferably by sewing.

Figure 5:
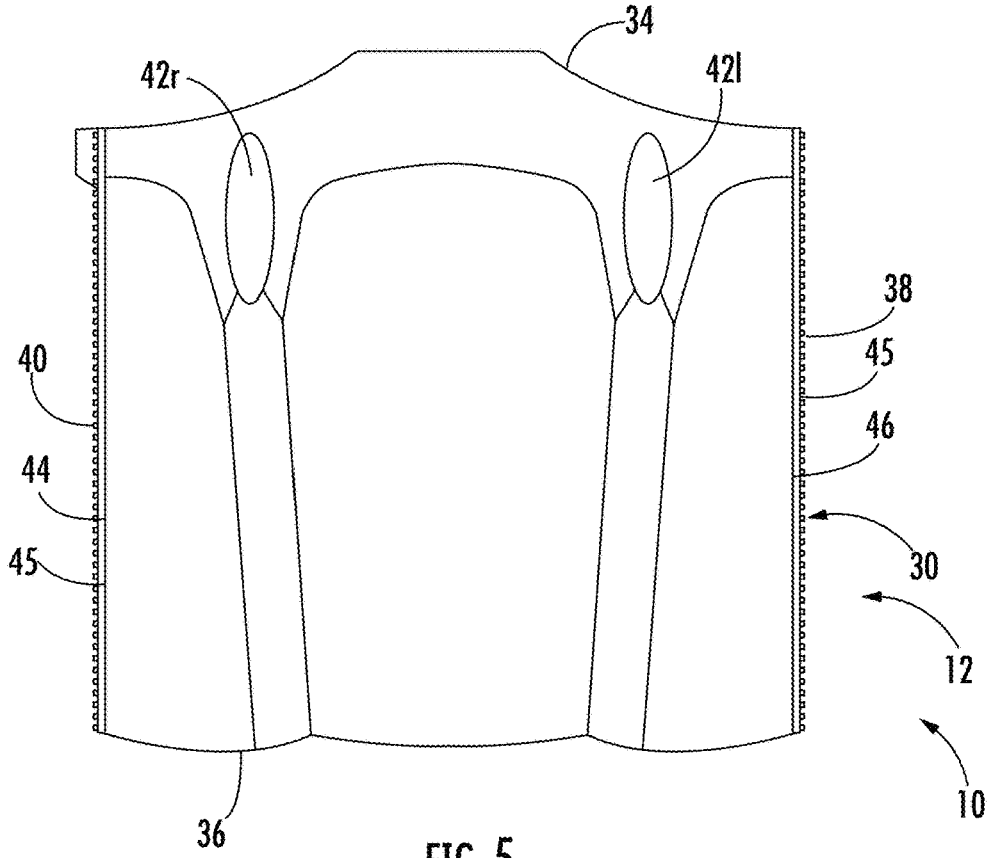
FIG. 5 is a schematic illustration of an outer fabric panel that is one component of the carrier of FIG. 1, as viewed from the body side.

Assembly of the carrier 12 preferably starts with the carrier outer layer 30 (FIG. 5). In FIG. 5, the outer carrier layer 30 is viewed from the body side, that is, from the side closer to the user when being worn. The outer layer 30 extends over all or substantially all of the exterior of the vest 10 when the vest 10 is being worn by a user. In the illustrated vest embodiment 10, the outer layer 30 is not flat, but rather is three-dimensional. As such, it is made from a number of individual pieces of fabric sewn together with stitching sections. In other embodiments of the invention, the outer layer 30 can be made from more or fewer fabric pieces, and the pieces may be joined to each other in a manner other than by sewing.

Each fabric panel of the carrier panel can utilize stretch knits or woven fabrics of varying weights and elasticity/stretch. Some fabric panels may have more elasticity/stretch than others. The fabrics may incorporate wicking, antimicrobial and/or cooling features throughout the carrier, or such features may be incorporated in strategic panel locations. One material that has been found to be suitable is the type of material that is used for cycling jerseys.

Some fabric panels of the carrier 12 are preferably, but not necessarily, made from a different fabric than others. For example, some fabric panels may be made from a higher compression material to help keep the ballistic panels in place during movement; others may be made from a material that has less compression for ease of movement and comfort. The goal is to balance these aspects to achieve the right amount of compression to stabilize the ballistic panels while still providing a high degree of movement and comfort.

The carrier outer layer 30 (FIG. 5) has an upper edge 34, a lower edge 36, a left side edge 38, and a right side edge 40. (The right side edge 40 is to the left as viewed in FIG. 5, because the outer layer 30 is viewed, in FIG. 5, from the body side or inside.) Two armholes 42*r* and 421 are located near the upper edge 34.

A right section 44 of a front zipper 45 is secured to the right side edge 40 of the outer layer 30, and a left section 46 of the zipper 45 is secured to the left side edge 38 of the outer layer. One preferred type of zipper that has been utilized is a separating coil zipper. Coil type zippers are known for their ability to operate under high degrees of horizontal strength, are very flexible and are the least likely to become misaligned. However, the invention contemplates that other types of zippers, and other closure technologies, may be utilized.

Figure 6:
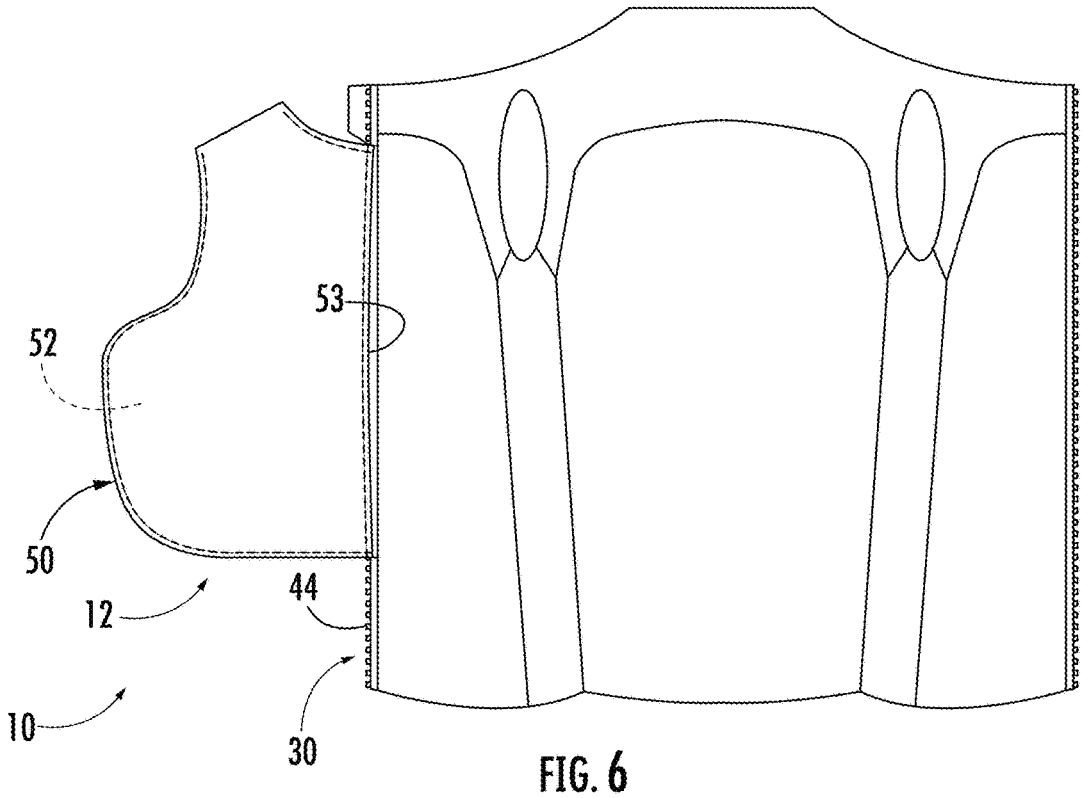
FIG. 6 is a schematic illustration similar to FIG. 5, showing a front ballistic panel flap pocket added to the outer layer.

One step in assembly of the carrier 12 is the addition of the front panel flap 50 to the outer layer 30 (FIG. 6). The front panel flap 50 is secured to the inside of the outer layer 30, just inside the right zipper portion section 44, preferably by sewing. The front panel flap 50 is formed of two layers of fabric with an open space or pocket between them; only one of these layers (the hidden layer in FIG. 6) is sewn to the outer layer 30. An opening 53 into this pocket runs along the right zipper section 44, so that a lateral portion of the front ballistic panel 14 can be inserted laterally into the pocket in the front panel flap 50, in a manner described below.

Figure 7:
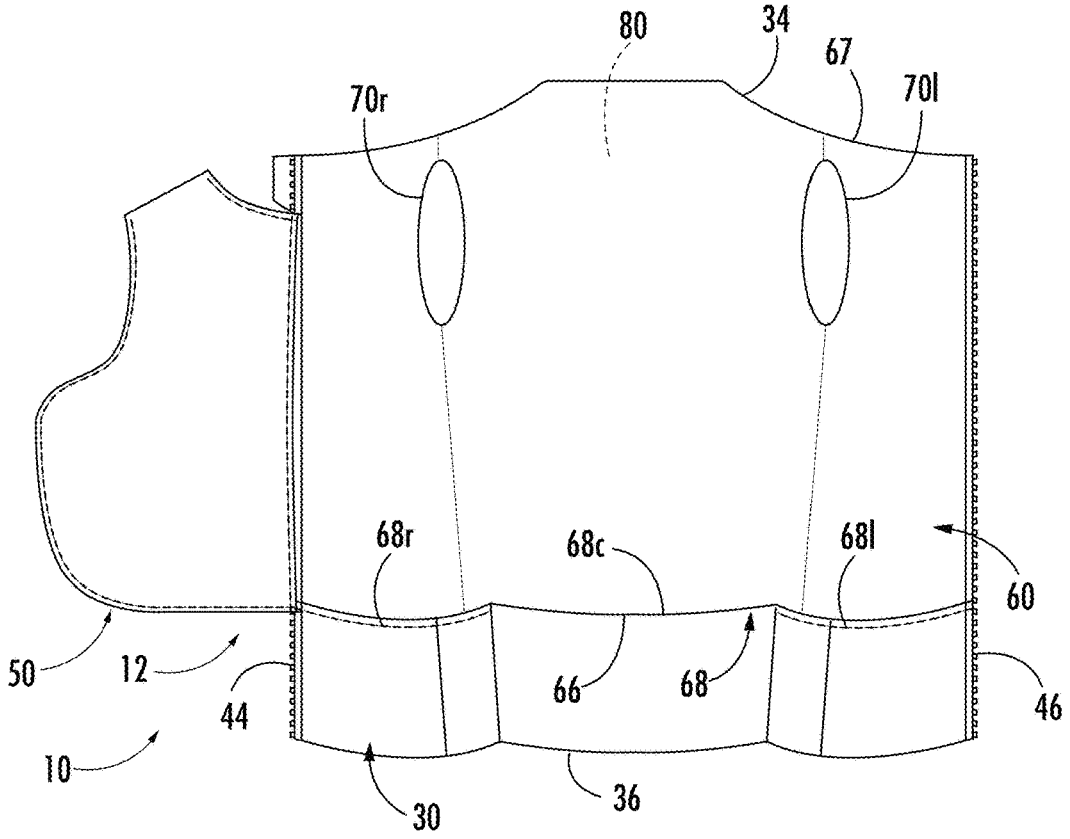
FIG. 7 is a schematic illustration of the carrier of FIG. 6, showing an inner fabric panel added to the outer fabric panel.
Figure 8:
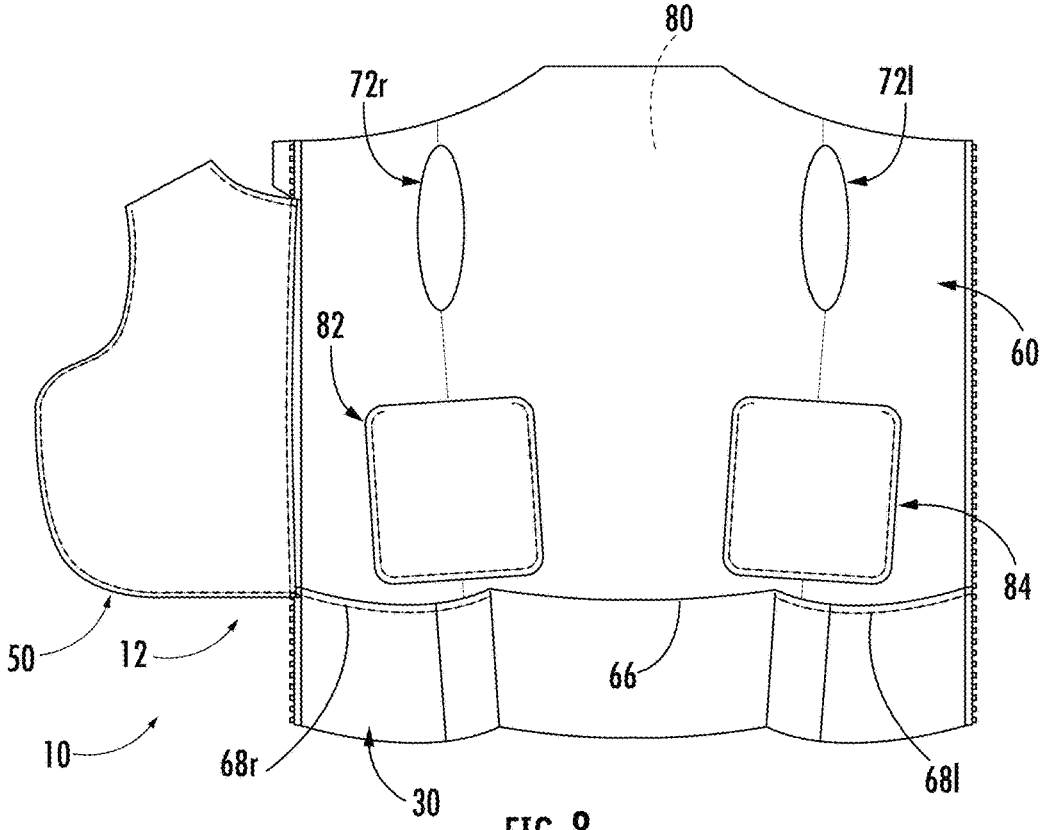
FIG. 8 is a schematic illustration similar to FIG. 7, showing left and right side panel pockets added to the inner layer of the carrier.

After the front panel flap 50 is secured to the outer layer 30, the inner carrier layer 60 (FIGS. 7 and 8) is secured to the outer carrier layer 30, preferably by sewing. Specifically, an upper edge 67 of the inner layer 60 is secured along the upper edge 34 of the outer layer 30. A lower edge 68 of the inner layer 60 is secured to the outer layer 30 with two laterally spaced stitching sections 68*r* and 681, at a location upward from the lower edge 36 of the outer layer 30. A central opening 68*c* is left between the stitching sections 68*r* and 68*l*. The right and left edges of the inner layer 60 are not sewn down to the outer layer 30.

Two arm holes 70*r* and 701 in the inner layer 60 overlie the armholes 42*r* and 421, respectively, in the outer layer 30, forming vest armholes 72*r* and 721 in the completed carrier 12. The inner layer 60 is sewn to the outer layer 30 around the periphery of the vest armholes 72*r* and 721, to secure the two carrier layers together at those locations.

The carrier 12 at this point in the assembly process has two layers of fabric at the areas where the inner layer 60 overlies the outer layer 30. Because those two layers of fabric, the inner carrier layer 60 and the outer carrier layer 30, are joined only along their respective upper and lower edges, a panel volume or panel space, designated 80 in the drawings, is formed between the inner layer and the outer layer. The panel space 80 is bounded generally by the top edges 67 and 34 of the inner and outer carrier panels 60 and 30; the right and left vest armholes 72*r* and 721, and the bottom edge 68 of the inner carrier panel. The inner layer 60 can be pulled away from the outer layer 30 to receive and support the front and back ballistic panels 14 and 16, respectively, in the panel space 80, in a manner as described below.

In a further assembly step (FIG. 8), the right and left side panel pockets 82 and 84, respectively, are secured to the inner layer 60, preferably by sewing. Each one of the side panel pockets 82 and 84 preferably includes two layers of fabric material. Each side panel pocket 82, 84 has a top opening, which may be closable by a zipper (not shown), to allow for insertion of its respective side ballistic panel 20, 18.

Figure 9:
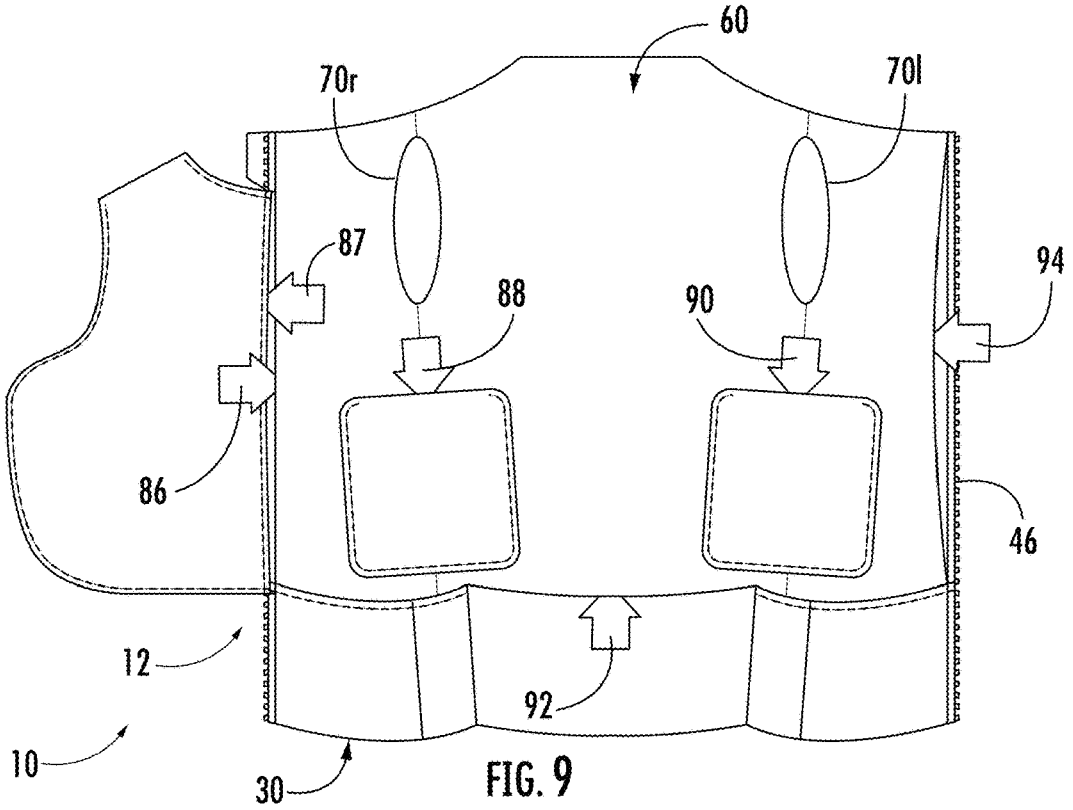
FIG. 9 is a schematic illustration similar to FIG. 8, with arrows indicating locations of insertion of the ballistic panels into the carrier.

When the carrier 12 is thus fully assembled, there are a number of openings or gaps through which the various ballistic panels can be placed into the pockets. Some of these openings or gaps are illustrated in FIG. 9. Specifically, the arrow 86 illustrates an opening between the outer layer 30 and the inner layer 60 into which a first lateral section of the front ballistic panel 14 can be inserted into the panel space 80. The arrow 87 illustrates an opening between the outer layer 30 and the inner layer 60 into which a second lateral section of the front ballistic panel 14 can be inserted into the front panel flap 50.

The arrow 88 illustrates an opening into which the right side ballistic panel 20 can be inserted into the right side pocket 82. The arrow 90 illustrates an opening into which the left side ballistic panel 18 can be inserted into the left side pocket 84. The arrow 92 illustrates an opening into which the back ballistic panel 16 can be inserted upwardly into the panel space 80. Also shown is an opening 94 at the left zipper section 46 into which the front panel flap 50 can be inserted, into the panel space 80 between the inner layer 60 and the outer layer 30.

Figure 10:
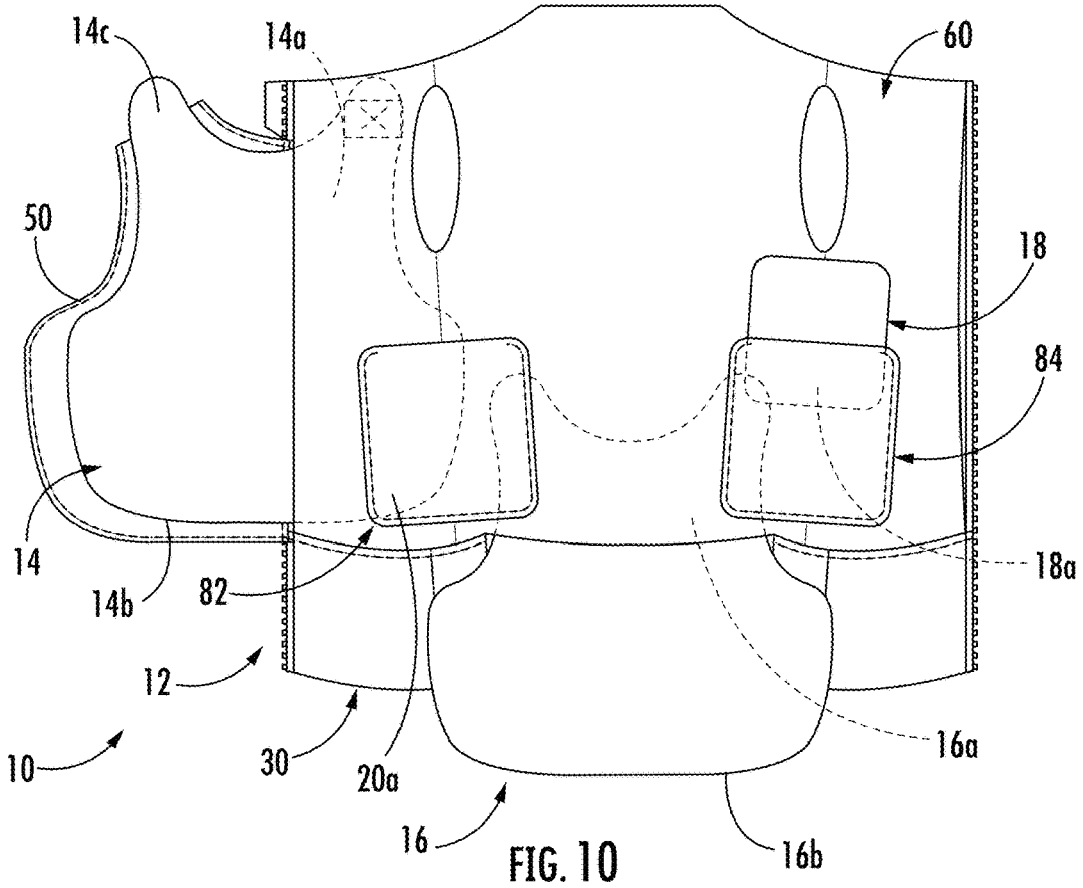
FIGS. 10 and 11 are schematic illustrations similar to FIG. 9, showing steps in the process of the insertion of the ballistic panels.
Figure 11:
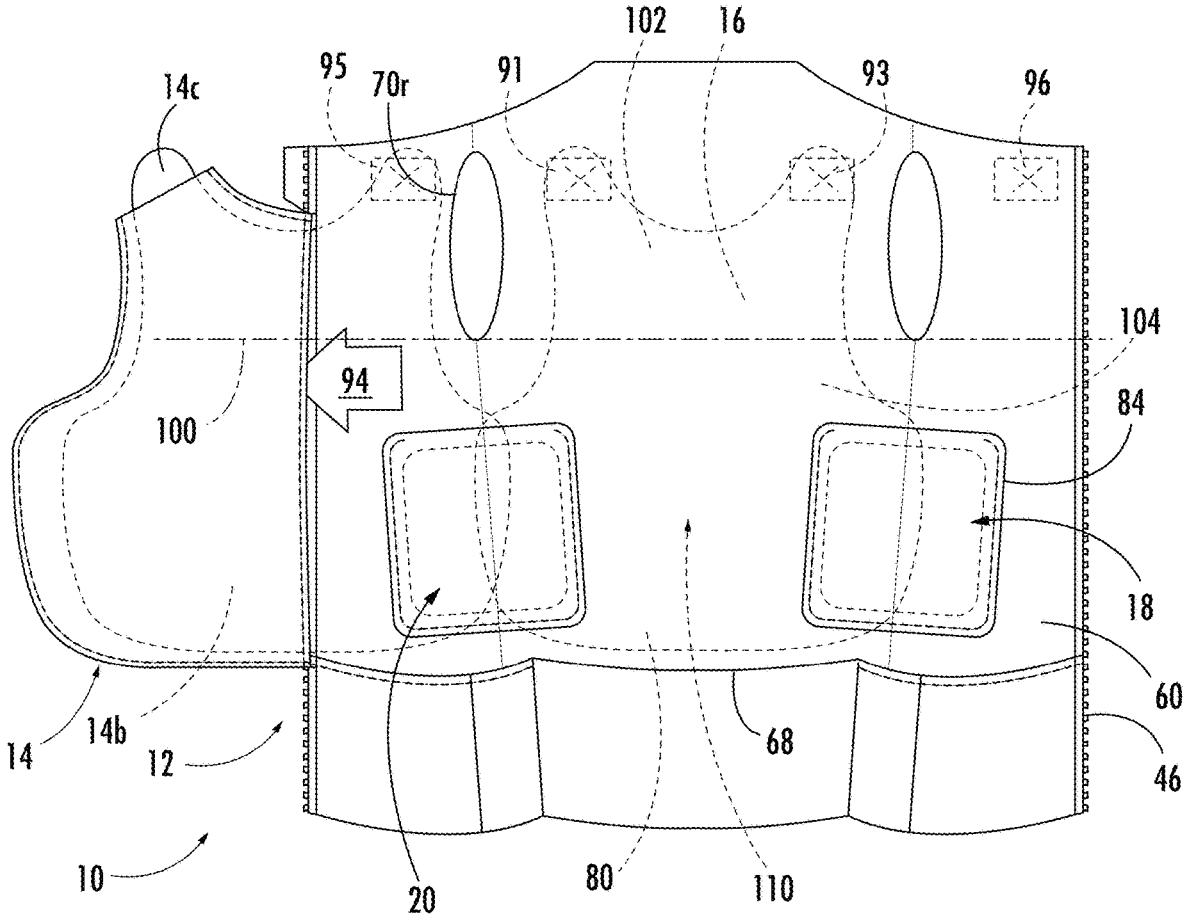

The ballistic panels can be inserted into the carrier 12 in any selected order. One preferred order of steps is shown in FIGS. 10 and 11. In FIG. 10, a first lateral section 14*a* of the front ballistic panel 14 is placed through the opening 86 into the panel space 80 between the inner carrier layer 60 and the outer carrier layer 30. The first lateral section 14*a* of the front ballistic panel 14 is secured (suspended) in the carrier 12 at a fixation point 95. This fixation may occur via a hook and loop connection, or otherwise. This fixation point 95 is located in the panel space 80, at or near the top edge of the carrier 12.

The fixation point 95 is primarily to hold the front panel 14 in place in the carrier, in the event of a bullet impacting that area of the vest 10. Primarily, though, the front panel 14 is substantially held in position in the panel space 80 by a close fit within the carrier as described above, and by the bottom seam 68.

The back ballistic panel 16 is inserted upward through the opening 92 into the panel space 80 between the inner layer 60 and the outer layer 30. The back ballistic panel 16 is secured (suspended) in the carrier 12 at two fixation points 91 and 93. This fixation may occur via a hook and loop connection, or otherwise. These fixation points 91 and 93 are located in the panel space 80, at or near the top edge of the carrier 12. Again, the fixation points 91 and 93 are primarily to hold the back panel 16 in place in the carrier, in the event of a bullet impacting that area of the vest 10.

The left side ballistic panel 18 is placed through the opening 90 into the left side panel pocket 84. The right side ballistic panel 20 is placed through the opening 88 into the right side panel pocket 82. The side panel pockets 82 and 84 are closed with their fasteners.

As shown in FIG. 11, the second lateral section or remainder 14*b* of the front ballistic panel 14 is placed through the opening 53 into the pocket in the front panel flap 50. As a result, half of the front ballistic panel 14 is located in the panel space 80 between the outer layer 30 and the inner layer 60, and the other half is contained within the front panel flap 50, projecting from the right side edge of the carrier 12 at a location adjacent to but inside the right zipper section 44. An upper edge portion 14*c* of the panel 14 extends out of an opening in the upper corner of the front panel flap 50.

Figure 12A:
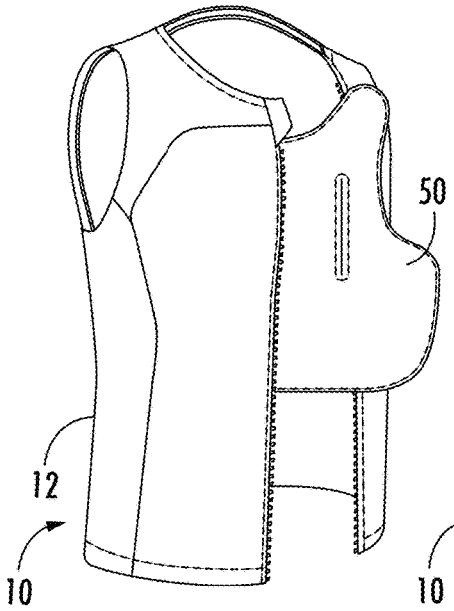
FIGS. 12A-12C are a series of views illustrating the final steps in donning the vest of FIG. 1.
Figure 12B:
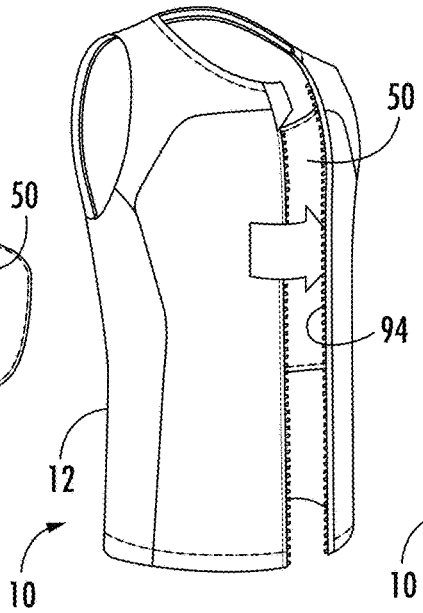
Figure 12C:
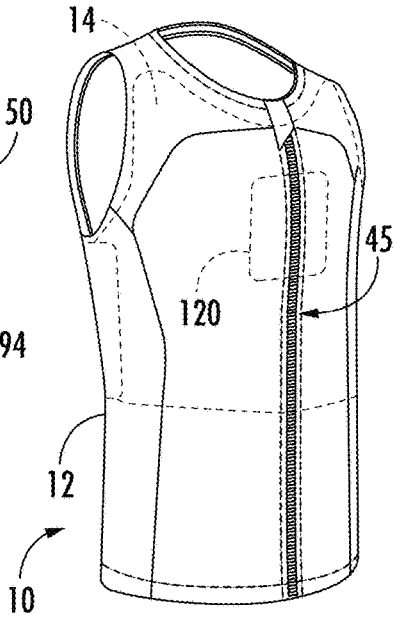

The user can then don the vest 10, in a manner as illustrated in FIGS. 12A-12C. The user's arms are placed through the vest armholes 721 and 72*r* while donning the vest 10. The right side of the vest 10, with the front panel flap 50 projecting, is moved adjacent to the left side of the vest 10. The projecting front panel flap 50 is flipped over and inserted through the opening 94 (FIG. 12B) between the outer layer 30 and the inner layer 60, along the left zipper section 46, thus being moved as one piece into the panel space 80. This action locates the front ballistic panel 14 completely in the panel space 80 between the outer layer 30 of the carrier 12 and the inner layer 60 of the carrier 12.

The second lateral section 14*b* of the front ballistic panel 14 (the projecting upper edge portion 14*c*) is then secured (suspended) in the carrier 12 at a fixation point 96. This fixation may occur via a hook and loop connection, or otherwise. This fixation point 96 is located in the panel space 80, at or near the top edge of the vest.

The zipper 45 is zipped up, drawing the left side of the carrier 12 together with the right side of the carrier 12. In this condition, the front ballistic panel 14 extends across the upper torso area of the user. This is a continuous placement, extending across the front zipper opening of the vest 10, thus providing complete front protection. The left side ballistic panel 18 overlies the left side of the user's torso. The right side ballistic panel 20 overlies the right side of the user's torso. The back ballistic panel 16 overlies the upper back of the user's torso.

Figure 4:
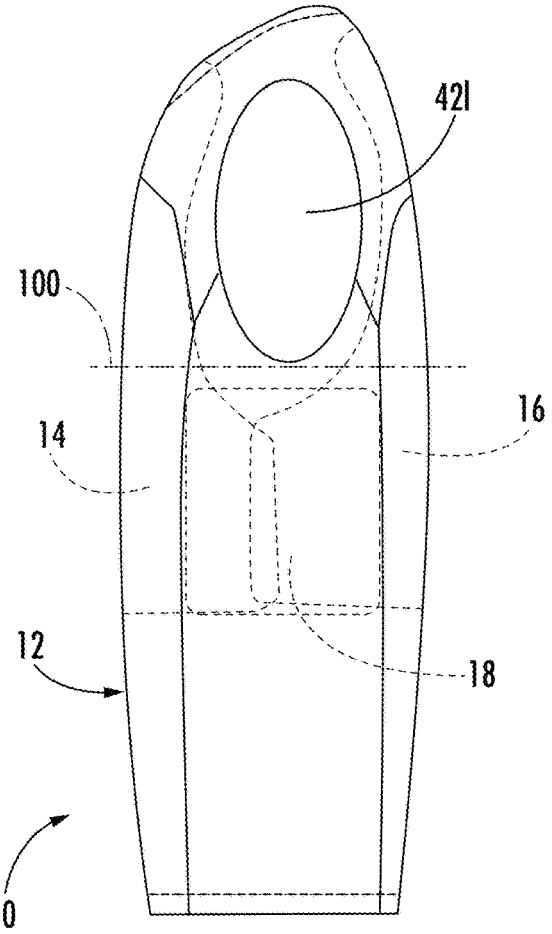
FIG. 4 is a left side elevational view of the vest of FIG. 1.

An upper section 102 of the back panel 16 is disposed within the panel space 80 in the carrier 12, above an imaginary line 100 (FIGS. 4 and 11) that extends laterally across the vest 10 at a location at or just below the lower edge of the vest armholes 721 and 72*r*. The back panel upper section 102 is fixed to the carrier 12, within the panel space 80, at the two fixation points 90 and 92. These fixation points 90 and 92 (which are above the line 100), together with the sewn armholes 721 and 72*r*, substantially constrain lateral movement of the back panel upper section 102 in the panel space 80 in the carrier 12.

In contrast, the part of the panel space 80 that is below the imaginary line 100 and above the bottom edge 68 of the inner carrier panel 60, can be considered as being a tunnel 110, being open from side to side with no significant lateral obstructions. A lower section 104 of the back panel 16 extends downward from the upper section 102 into this tunnel 110, below the imaginary line 100 and below the bottom edge of the left and right armholes 721 and 72*r*. The lower section 104 of the back panel 16 is supported in the tunnel 110 only by the upper section 102 of the back panel. The back panel lower section 104 is thus substantially freer to move laterally in the tunnel portion 110 of the panel space 80 than is the upper section 102, as it is substantially less constrained laterally.

In the tunnel 110, the back panel lower section 104 at least partially overlaps the left and right ballistic side panels 18 and 20. The back panel lower section 104 is movable laterally relative to the left and right ballistic side panels 18 and 20

In a similar manner, a lower section 112 of the front panel 14, disposed in the tunnel 110, at least partially overlaps the left and right ballistic side panels. The front panel lower section 112 is movable laterally relative to the left and right ballistic side panels 18 and 20. The front panel lower section 112 and the back panel lower section 104 are also movable laterally relative to each other.

As thus constructed, the vest 10 provides numerous benefits when being worn by the user. The ability of the front panel lower section 112 and the back panel lower section 104 to move laterally within the tunnel portion 110 of the carrier panel space 80, provides a very significant benefit. With the carrier itself being a snug fit on the user's torso, this feature allows for increased movement of the front and back ballistic panels 14 and 16 with respect to the user's torso.

The vest 10 adjusts itself to the user's torso. The ballistic panels to some extent "self center" when the vest 10 is donned, because of the flexible fabric and the ability of the lower portions of the front and back panels 14 and 16 to move within the carrier 12. The ballistic panels 14 and 16 can move, or float, as the body moves. The dimensions of the various parts of the vest 10 are selected so that the parts can move or articulate relative to one another, while staying in generally the right location as needed for protection. As a result, the vest 10 of the present invention is both protective and comfortable.

The lower portions of the front and back panels 114 and 16 are constrained laterally only by the compression of the vest 10 on the torso, the armhole blockage (the width of the carrier), and the dimensions of the various parts. The dimensions of each element, and their placement, are selected to enable this limited amount of freedom of movement (articulation) in the tunnel area, which is located at the waist of the user where it is most needed.

The elasticity of the fabric material of the carrier 12, especially the outer layer 30 and the inner layer 60, also allows for some movement or articulation of the various ballistic panels relative to each other. Because the carrier fabric material is quite thin, the ballistic panels can lie closely against the user's torso. This structure, as a whole, compares very favorably to a typical vest 10 that is rigid and heavy and non-conforming.

As a result, the vest 10 as a whole is not a rigid structure but is rather a flexible structure overall that includes relatively hard areas at the locations of the ballistic panels—with at least several inches of movement possible in many locations and in many directions. This makes the vest 10 much more comfortable.

As an analogy, It might be considered that the side panels 18 and 20 are like the rib cage—fixed, relatively stationary—while the front and back panels 14 and 16 are like the shoulder blades—held in place generally by tendons and muscles, but able to move around somewhat relative to the rib cage. Just as the shoulder blades can move around over the rib cage, so too can the front and back panels 14 and 16 move around over the side panels 18 and 20.

Another benefit of the vest 10 lies in the area of load distribution. Specifically, a ballistic vest can be relatively heavy for a law enforcement officer to wear, especially for an extended period of time such as an all-day shift. Also, the load (weight) of a vest is typically carried primarily by the shoulder straps of the vest, bearing down on the officer's shoulders. Together, these factors can create discomfort or pain, and can tire the wearer.

In accordance with the present invention, the vest 10 is preferably configured and sized appropriately for the user, so that there is a snug fit on the user's torso. The material for the outer and inner carrier layers 30 and 60 is significantly stretchable and elastic. The resulting elasticity of the carrier 12 tends to hold the vest 10 in place on the user's torso, thus resisting downward movement of the vest along the torso of the user. In addition, the carrier 12 is made from a light weight, relatively inexpensive fabric and therefore can feasibly be made in a variety of sizes to fit different sized users. Thus, the desired snug fit can readily be obtained, while still allowing for the panel articulation described above. As a result, some of the load of the vest 10 is transferred onto the core of the user. This load distribution reduces the apparent load on the shoulder and collarbone area of the user, making it more comfortable to wear the vest 10 for a longer period of time without tiring.

The dimensions of the carrier are designed for the individual user (different sizes), to be tight along the core and thus press the ballistic panels snugly against the core of the user's body. When this occurs, some of the load (weight) of the vest is borne by the user's core rather than the shoulders, making wearing of the vest for an extended period of time more comfortable. The ballistic panels are in their proper places for protection, when the user stands up straight. When the user bends over, the overall configuration of the carrier fabric deforms as it moves to a different position on the body. The ability of the panels to articulate (move within the carrier) enables the vest to remain comfortable, as compared to a situation in which the panels would be pushed or pulled by the carrier fabric when it moves to a different position on the body. The panels will self center or auto center as the user comes back to a standing position. Because the panels are loose, the carrier can stay snug on the user's waist and core, thus maintaining the effectiveness of this load bearing feature.

Figure 13:
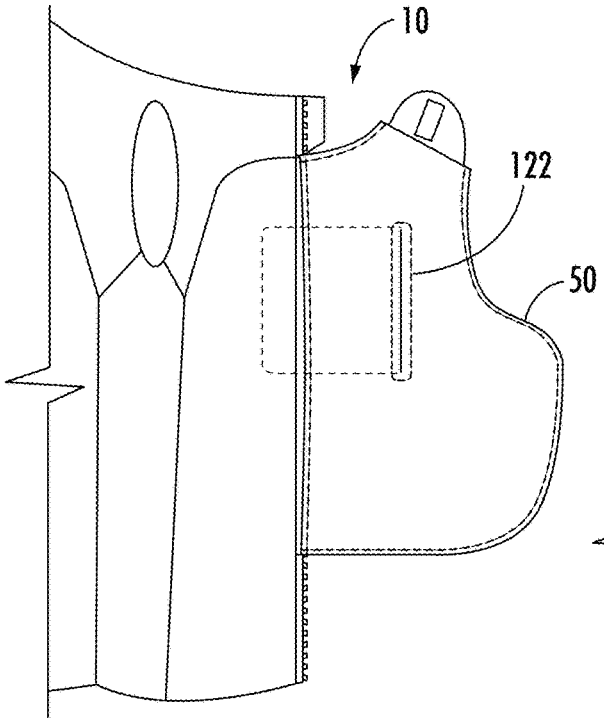
FIGS. 13 and 14 illustrate the inclusion and positioning of a trauma plate in a pocket.
Figure 14:
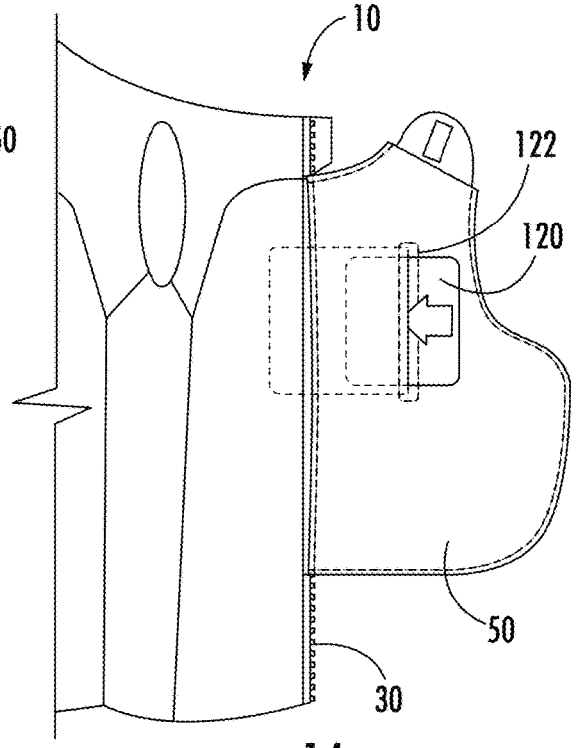

FIGS. 13 and 14 illustrate the inclusion and positioning of an optional trauma plate 120 (hard plate) in a pocket 122 on the carrier 12 of the vest 10. The pocket 122 is located on the outer side (strike face) of the front ballistic panel flap 50. The plate 120 may be inserted before the vest is donned. The plate 120 ends up on the outside (strike side) of the front ballistic panel 14, which like the other ballistic panels 16, 18, and 20 is soft armor. The pocket 122 is preferably located so that it and the plate 120 are centered laterally on the front of the vest 10.

Figure 15:
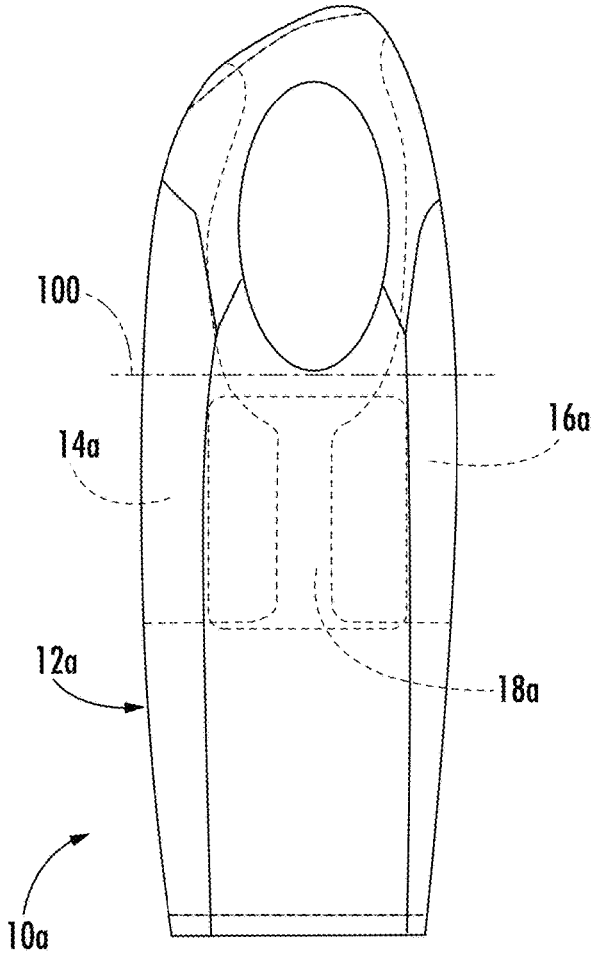
FIGS. 15 and 16 illustrate additional embodiments of the invention, including side ballistic panels.
Figure 16:
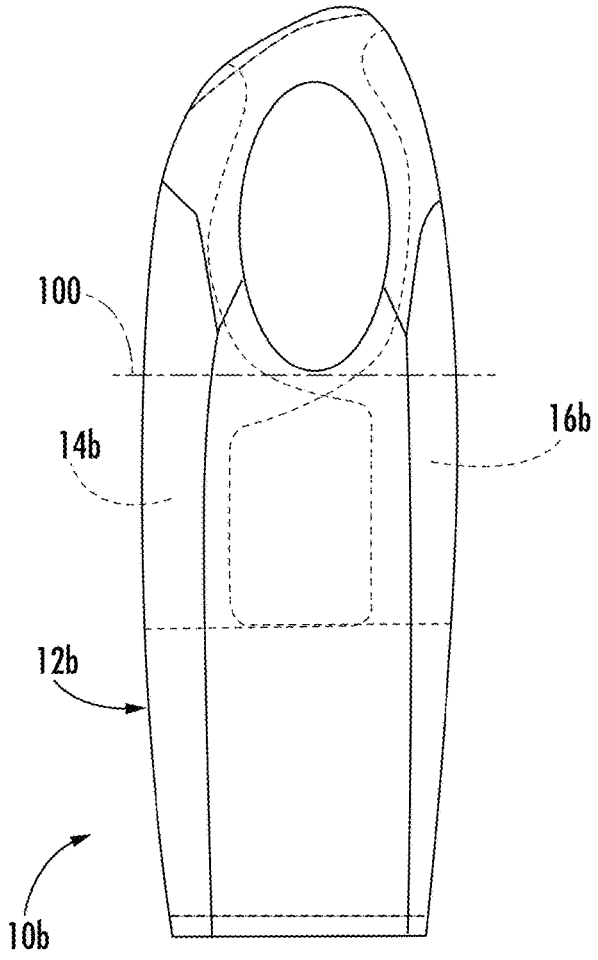

In the first embodiment of the invention illustrated and described above, four ballistic panels are provided. The front panel and the back panel overlap each other and also overlap the side panels (see FIG. 4). Other embodiments are possible. In the vest 10*a* shown in FIG. 15, for example, both the front panel and the back panel overlap the side panels, but do not overlap each other. In the vest 10*b* shown in FIG. 16, for example, no side panels are present, as is the case with many vests, so the front and back panels overlap each other. The front panel and the back panel are configured as needed for the desired amount of overlap.

Although the invention has been described in terms of particular embodiments and applications, one of ordinary skill in the art, in light of this teaching, can generate additional embodiments and modifications without departing from the spirit of or exceeding the scope of the claimed invention. Accordingly, the scope of the invention is limited only by the claims.

The invention claimed is:

1. A ballistic vest, comprising:

a carrier; and a plurality of ballistic panels supported in the carrier, including a front panel for extending across the front of a user's torso when the vest is being worn by the user;

the carrier having first and second lateral front sides when the vest is donned, and the carrier also having a front zipper for joining said first and second lateral front sides at the front of the vest when the vest is donned;

the carrier being made from at least two layers of material including an inner layer and an outer layer which are joined to each other at their top and bottom;

the carrier inner and outer layers defining between them a panel space in the carrier that is accessible through side openings between the carrier inner and outer layers;

the carrier including a flap pocket extending from the outer layer panel adjacent the side opening on the first lateral front side of the carrier;

a first lateral section of the front panel being located in the panel space in the carrier on one lateral front side of the carrier, adjacent to the flap pocket;

a second lateral section of the front panel being located within the flap pocket; and when the ballistic vest is donned, the flap pocket, having the second lateral section of the front panel therein, being inserted between the inner and outer carrier layers and thereby located in the panel space in the carrier on the second lateral front side of the carrier.

2. The vest as set forth in claim 1 wherein the second lateral section of the front panel has an upper edge portion that projects outward of the flap pocket to be connected with one of the carrier inner and outer layers at a location inside the carrier.

3. The vest as set forth in claim 1 wherein:

the front panel has an upper section that is positioned in an upper part of the panel space, the carrier substantially constraining lateral movement of the front panel upper section within the panel space;

the front panel having a lower section that is positioned in a lower part of the panel space, the front panel lower section being substantially free to move laterally in the panel space;

the back panel having an upper section that is positioned in the upper part of the panel space, the carrier substantially constraining lateral movement of the back panel upper section within the panel space; and the back panel having a lower section that is positioned in the lower part of the panel space, the back panel lower section being substantially free to move laterally in the panel space.

4. A ballistic vest, comprising:

a carrier made from at least two layers of material including an outer layer and an inner layer that are joined to each other at least partially at the top of the vest;

the carrier having portions defining a left armhole and a right armhole;

the two carrier layers defining between them a panel space in the carrier;

at least two ballistic panels suspended in the panel space at or above the left and right armholes, including a front ballistic panel and a back ballistic panel;

the carrier having portions that substantially constrain lateral movement of the front and back panels between the armholes, and the carrier substantially enabling lateral movement of the front and back panels below the armholes; wherein the carrier has first and second lateral front sides when the vest is donned, and the carrier also having a front fastener for joining said first and second lateral front sides at the front of the vest when the vest is donned;

the carrier includes a flap pocket extending from the outer layer;

a first lateral section of the front panel is located in the panel space in the carrier on the first lateral front side of the carrier, adjacent to the flap pocket;

a second lateral section of the front panel is located within the flap pocket; and when the ballistic vest is donned, the flap pocket, having the second lateral section of the front panel therein, is inserted between the inner and outer carrier layers and thereby located in the panel space in the carrier on the second lateral front side of the carrier.

* * * * *